US011590526B2

(12) United States Patent
Zhuo et al.

(10) Patent No.: US 11,590,526 B2
(45) Date of Patent: Feb. 28, 2023

(54) HANGING STRUCTURE AND HANDHELD SHOWER

(71) Applicant: Xiamen Solex High-Tech Industries Co., Ltd., Xiamen (CN)

(72) Inventors: Zhiwei Zhuo, Xiamen (CN); Donghai Chen, Xiamen (CN); Fengde Lin, Xiamen (CN)

(73) Assignee: Xiamen Solex High-Tech Industries Co., Ltd., Xiamen (CN)

( * ) Notice: Subject to any disclaimer, the term of this patent is extended or adjusted under 35 U.S.C. 154(b) by 210 days.

(21) Appl. No.: 16/999,229

(22) Filed: Aug. 21, 2020

(65) Prior Publication Data

US 2021/0053083 A1 Feb. 25, 2021

(30) Foreign Application Priority Data

Aug. 21, 2019 (CN) ..... 201921361071.9

(51) Int. Cl.
*B05B 15/62* (2018.01)
*E03C 1/06* (2006.01)

(52) U.S. Cl.
CPC ..... *B05B 15/62* (2018.02); *E03C 1/06* (2013.01)

(58) Field of Classification Search
CPC ..... B05B 1/18; B05B 15/62; B05B 1/1609
See application file for complete search history.

(56) References Cited

U.S. PATENT DOCUMENTS

| | | | | |
|---|---|---|---|---|
| 9,919,331 | B2 * | 3/2018 | Scheffer | E03C 1/06 |
| 2016/0236223 | A1 * | 8/2016 | Scheffer | E03C 1/06 |
| 2017/0014849 | A1 * | 1/2017 | Gao | B05B 15/62 |
| 2018/0339300 | A1 * | 11/2018 | Lin | B05B 15/65 |
| 2019/0299224 | A1 * | 10/2019 | Wu | B05B 1/16 |

FOREIGN PATENT DOCUMENTS

| | | | | |
|---|---|---|---|---|
| CN | 208554775 | * | 3/2019 | B05B 1/18 |
| CN | 110144999 A | * | 8/2019 | B05B 15/62 |

* cited by examiner

*Primary Examiner* — Qingzhang Zhou
(74) *Attorney, Agent, or Firm* — Cooper Legal Group, LLC

(57) ABSTRACT

A hanging structure comprises a hanging element and a hanging seat. Opposite sides of the hanging element and the hanging seat respectively comprise a hanging sleeve and a hanging hook configured to define a detachable hanging connection. The hanging sleeve comprises a receiving cavity, and a lower portion of the receiving cavity comprises an opening surface. A first side of the receiving cavity facing the hanging hook comprises a baffle board, and a lower end surface of the baffle board comprises an opening extending toward an upper end surface of the baffle board. The hanging hook comprises a first portion configured to be disposed in the receiving cavity and a second portion configured to be disposed in the opening.

13 Claims, 22 Drawing Sheets

HANGING STRUCTURE AND HANDHELD SHOWER

RELATED APPLICATIONS

This application claims priority to Chinese patent application number 201921361071.9, filed on Aug. 21, 2019, which is incorporated herein by reference.

FIELD OF THE DISCLOSURE

The present disclosure relates to a mounting structure, and more particularly to a hanging structure.

BACKGROUND OF THE DISCLOSURE

Successful hanging technology on the market today for showers often use magnetics. By placing strong magnets inside a handheld shower and a hanging seat, or by placing a strong magnet on either the handheld shower or the hanging seat and placing an iron piece on the other of the handheld shower and the hanging seat, the handheld showerhead can be magnetically held in place. The cost of a strong magnet is high and an instantaneous collision between the handheld shower and the hanging seat generates a lot of noise, which affects the experience.

BRIEF SUMMARY OF THE DISCLOSURE

The present disclosure provides a mounting structure, which can realize quick assembly and quick disassembly and has a simple structure and low cost, thereby overcoming the deficiencies of the existing techniques.

In order to solve the above technical problem, the present disclosure provides a hanging structure. The hanging structure comprises a hanging element and a hanging seat. Opposite sides of the hanging element and the hanging seat respectively comprise a hanging sleeve and a hanging hook configured to define a detachable hanging connection. The hanging sleeve comprises a receiving cavity, and a lower portion of the receiving cavity comprises an opening surface. A first side of the receiving cavity facing the hanging hook comprises a baffle board, and a lower end surface of the baffle board comprises an opening extending toward an upper end surface of the baffle board. The hanging hook comprises a first portion configured to be disposed in the receiving cavity and a second portion configured to be disposed in the opening. The second portion is disposed on a side of the first portion away from the hanging sleeve, and a side of the second portion away from the first portion is further connected to a third portion of the hanging hook. At least a portion of the second portion extends inward with respect to the first portion and the third portion to define a recess between the first portion and the third portion.

In another preferred embodiment, during a hanging process between the hanging hook and the hanging sleeve, the first portion is initially received in the receiving cavity and then the second portion is received in the opening.

In another preferred embodiment, the at least a portion of the second portion comprises an upper portion of the second portion that extends inward with respect to the first portion and the third portion to define the recess, and the recess between an upper portion of the first portion and an upper portion of the third portion.

In another preferred embodiment, the upper portion of the third portion comprises a space-providing opening configured to increase an opening width the recess.

In another preferred embodiment, a side of the upper portion of the first portion facing the hanging sleeve comprises a first guiding surface, and a second side of the receiving cavity away from the baffle board defines a first guiding coupling surface configured to cooperate with the first guiding surface.

In another preferred embodiment, an inner side wall of the baffle board facing the receiving cavity comprises a second guiding surface, and a side of the first portion facing the recess comprises a second guiding coupling surface configured to guide and cooperate with the second guiding surface.

In another preferred embodiment, the baffle board comprises a third guiding surface disposed on both sides of a lower end of the opening, and an upper end of the second portion comprises a third guiding coupling surface configured to cooperate with the third guiding surface.

In another preferred embodiment, the receiving cavity gradually and upwardly narrows from the opening surface in a width direction.

In another preferred embodiment, the receiving cavity gradually and upwardly narrows from the opening surface in a thickness direction.

In another preferred embodiment, the first portion is wedge shaped or a circular shaped, and two sides of the first portion respectively abut two side walls of the receiving cavity to achieve positioning.

In another preferred embodiment, a left side and a right side of the second portion are respectively disposed with straight sections, and a left side and a right side of the opening are respectively disposed with straight sections corresponding to the straight sections of the left side and the right side of the second portion.

In another preferred embodiment, a second side of the receiving cavity away from the baffle board is further disposed with a positioning pin, and the first portion is disposed with a positioning hole configured to cooperate with the positioning pin.

In another preferred embodiment, the positioning hole is a circular hole or a circular ring extending along a circumferential direction of a surface of the first portion.

The present disclosure further provides a handheld shower. The handheld shower comprises the aforementioned hanging structure. The hanging element is disposed on the handheld shower, and the hanging seat is disposed on a wall surface or a top spray shower.

Compared with the existing techniques, the technical solution has the following advantages.

1. The present disclosure provides a hanging structure in which, when the hanging hook is connected to the hanging sleeve, the first portion is received in the receiving cavity before the second portion is received in the opening. The first portion and the receiving cavity function as guides, so that the second portion can be smoothly received during the hanging process.

2. The present disclosure provides a hanging structure in which an upper portion of the third portion comprising the space-providing opening for increasing the opening width of the recess. By increasing the opening width of the recess using the space-providing opening, the range of the mounting angle of the handheld shower and the hanging seat can be increased, so that the user can more easily hang the handheld shower on the hanging seat.

3. The present disclosure provides a hanging structure in which, in order to increase a guiding performance of an entire assembly process, a total of three guiding processes are serially performed during the assembly process, ensuring that the handheld shower can be smoothly coupled to the hanging seat. The handheld shower will not shake when the assembly process is complete.

4. The present disclosure provides a hanging structure that comprises the positioning pin and the positioning hole. When the assembly process is complete, the positioning pin hits the positioning hole to make an indicator sound, prompting the user that the assembly process has been completed.

DETAILED DESCRIPTION OF THE EMBODIMENTS

Figure 1:
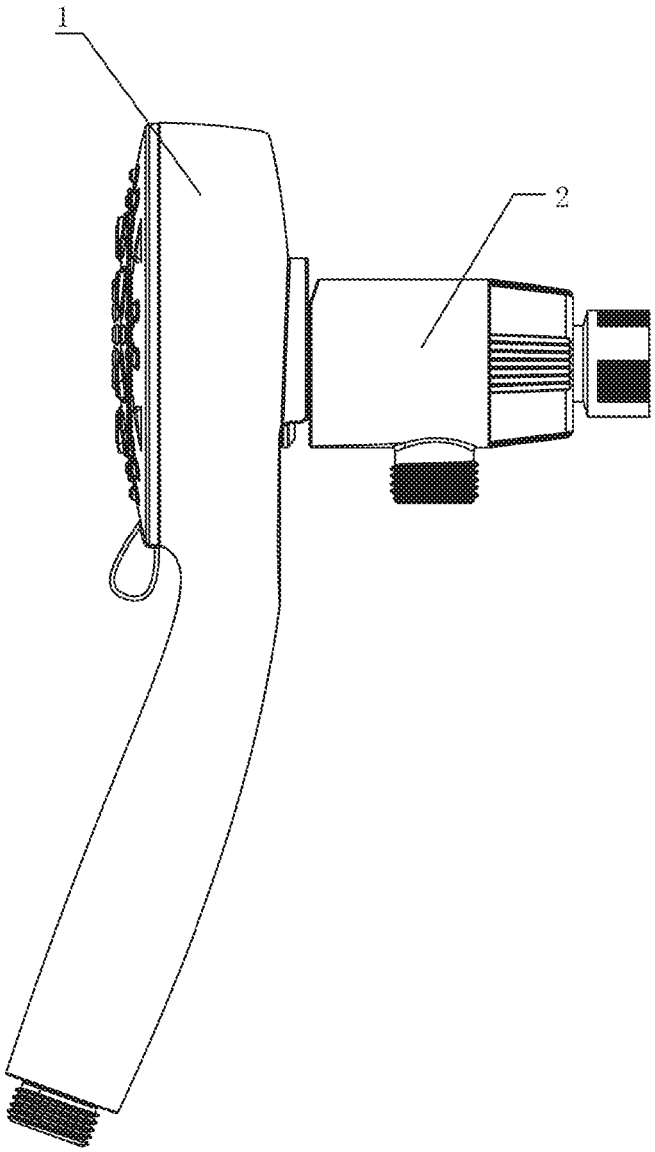
FIG. 1 illustrates a side view of a hanging connection between a handheld shower and a hanging seat of Embodiment 1 of the present disclosure.
Figure 2:
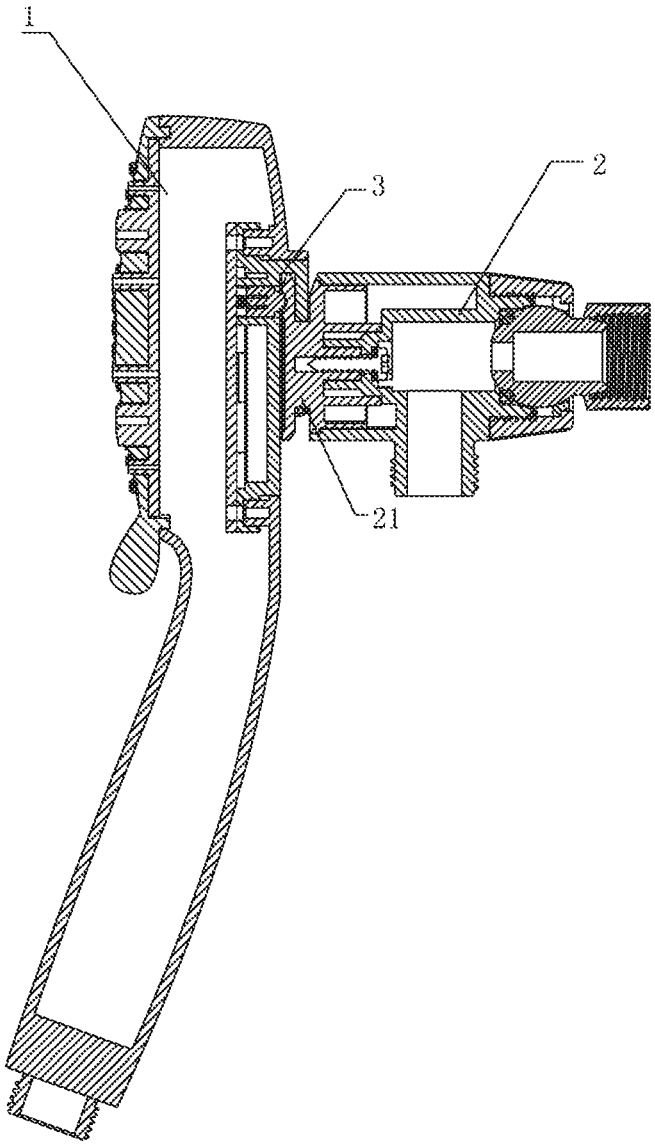
FIG. 2 illustrates a cross-sectional view of the hanging connection between the handheld shower and the hanging seat of Embodiment 1 of the present disclosure.
Figure 3:
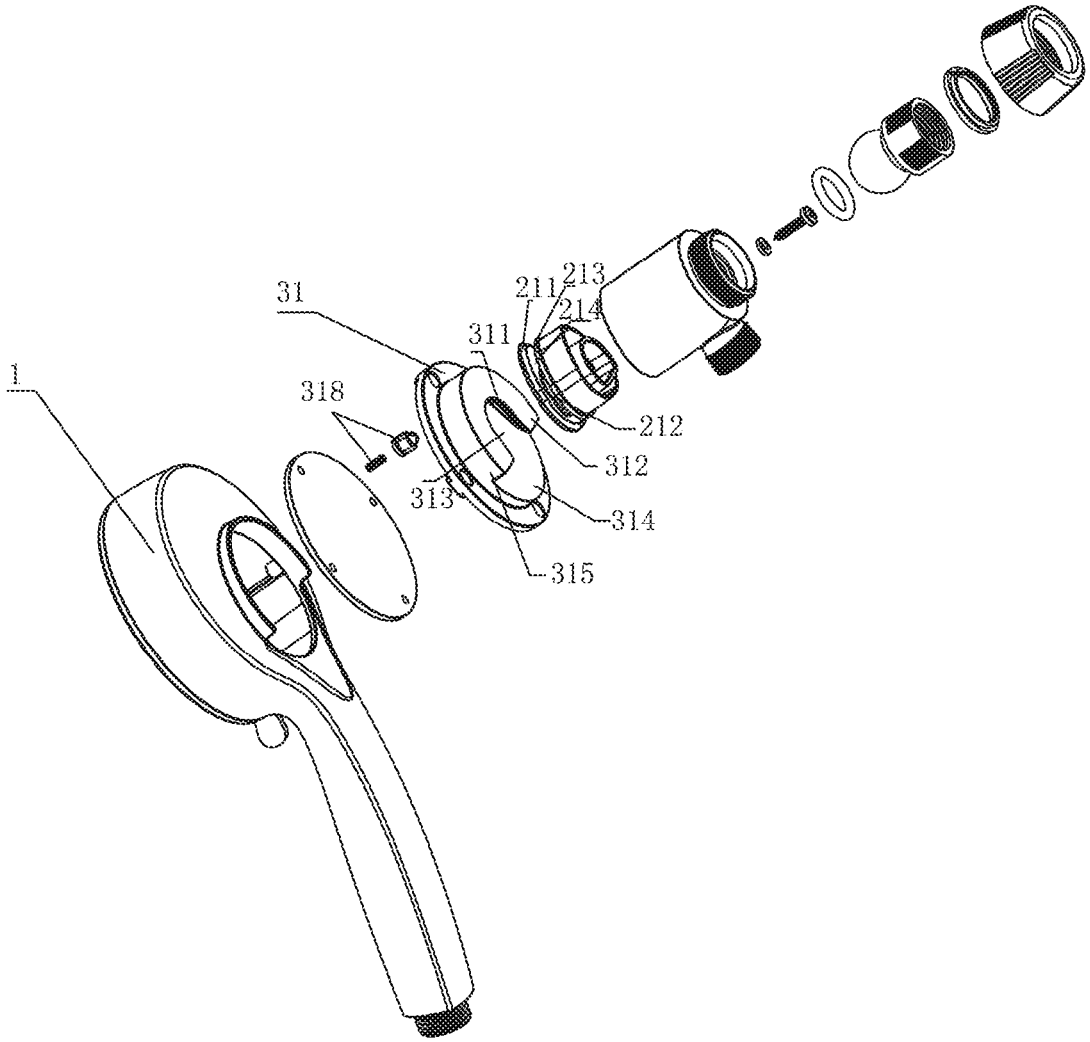
FIG. 3 illustrates an exploded diagram of the handheld shower and the hanging seat of Embodiment 1 of the present disclosure.

The present disclosure will be further described below in combination with the accompanying drawings and embodiments.

Embodiment 1

Referring to FIGS. 1-19, the present disclosure provides a hanging structure of a handheld shower. The hanging structure comprises a handheld shower 1 and a hanging seat 2. The hanging seat 2 is disposed on a wall surface, and a side of the handheld shower 1 facing the hanging seat 2 is disposed with a hanging element 3.

Opposite sides of the hanging element 3 and the hanging seat 2 respectively comprise a hanging sleeve 31 and a hanging hook 21 so as to define a detachable hanging connection. Positions of the hanging sleeve 31 and the hanging hook 21 are also interchangeable. That is, the hanging sleeve 31 may be disposed on the hanging seat 2, and the hanging hook 21 may be disposed on the hanging element 3. The simple variation of this embodiment is not described herein.

In some embodiments, the hanging sleeve 31 comprises a receiving cavity 311. A lower portion of the receiving cavity 311 comprises an opening surface 319, and a first side of the receiving cavity 311 facing the hanging hook 21 (e.g., facing the hanging seat 2) comprises a baffle board 312. A lower end surface of the baffle board 312 comprises an opening 313 extending toward an upper end surface of the baffle board 312. A second side of the receiving cavity 311 away from (e.g., opposite to) the baffle board 312 comprises a back plate 314, and a left side and a right side of the baffle board 312 extend toward the back plate 314 to define a connecting plate 315 connected to the back plate 314. The back plate 314, the connecting plate 315, and the baffle board 312 cooperates to define the receiving cavity 311.

The hanging hook 21 comprises a first portion 211 configured to be disposed in the receiving cavity 311 and a second portion 212 configured to be disposed in the opening 313.

In some embodiments, the second portion 212 is disposed on a side of the first portion 211 away from the hanging sleeve 31. A side of the second portion 212 away from the first portion 211 is further connected to a third portion 213 of the hanging hook 21. The second portion 212 extends inward with respect to the first portion 211 and the third portion 213 to define a recess 214 between an upper portion of the first portion 211 and an upper portion of the third portion 213. In this embodiment, the recess 214 extends along the entire length of a circumference of hanging hook 21. To achieve the technical solution of the embodiment, it is merely necessary to ensure that the recess 214 is defined between the first portion 211 and the third portion 213. As a simple variation of this embodiment, a portion of the second portion 212 extends inward with respect to the first portion 211 and the third portion 213.

During a hanging process between the hanging hook 21 and the hanging sleeve 31, the first portion 211 is initially received in the receiving cavity 311 and then the second portion 212 is received in the opening 313. The combination of the first portion 211 and the receiving cavity 311 function a guide to enable the second portion 212 to be smoothly disposed in the opening 313 to complete the hanging process.

The upper portion of the third portion 213 comprises a space-providing opening 215 configured to increase an opening width of the recess 214. After the space-providing opening 215 is used to increase the opening width of the recess 214 to enable a range of the hanging angle of the handheld shower 1 and the hanging seat 2 to be increased, users can more easily complete a hanging process to attach the handheld shower 1 to the hanging seat 2.

In this embodiment, in order to increase a guiding performance of an entire assembly process, three guiding processes are serially performed during the assembly process. The three guiding processes are further described as follows.

A side of the upper portion of the first portion 211 facing the hanging sleeve 31 comprises a first guiding surface 216. The second side of the receiving cavity 311 away from the baffle board 312, that is, the aforementioned back plate 314, defines a first guiding coupling surface configured to cooperate with the first guiding surface 216. In this embodiment, the first guiding surface 216 is an inclined guiding surface. After the first guiding surface 216 abuts the back plate 314, the back plate 314 slides downward relative to the first guiding surface 216 due to the first guiding surface 216 being inclined, so that the first portion 211 gradually enters into the receiving cavity 311 of the hanging sleeve 31; thereby a first guiding process is achieved.

An inner side wall of the baffle board 312 facing the receiving cavity 311 comprises a second guiding surface 316, and a side of the first portion 211 facing the recess 214 comprises a second guiding coupling surface 217 configured to guide and cooperate with the second guiding surface 316. In this embodiment, the second guiding surface 316 and the second guiding coupling surface 217 are both vertical planes, so that a front side and a rear side of the first portion 211 both function as guides. An inclined angle of the handheld shower 1 is gradually straightened to ensure that the handheld shower 1 can smoothly enter into the receiving cavity 311; thereby a second guiding process is achieved.

The baffle board 312 comprises a third guiding surface 317 disposed on both sides of a lower end of the opening 313. An upper end of the second portion 212 comprises a third guiding coupling surface 218 configured to cooperate with the third guiding surface 317. In this embodiment, the third guiding surface 317 and the third guiding coupling surface 218 are respectively circular arc surfaces. A purpose of a third guiding process is to enable the second portion 212 to smoothly enter into the opening 313.

Figure 9:
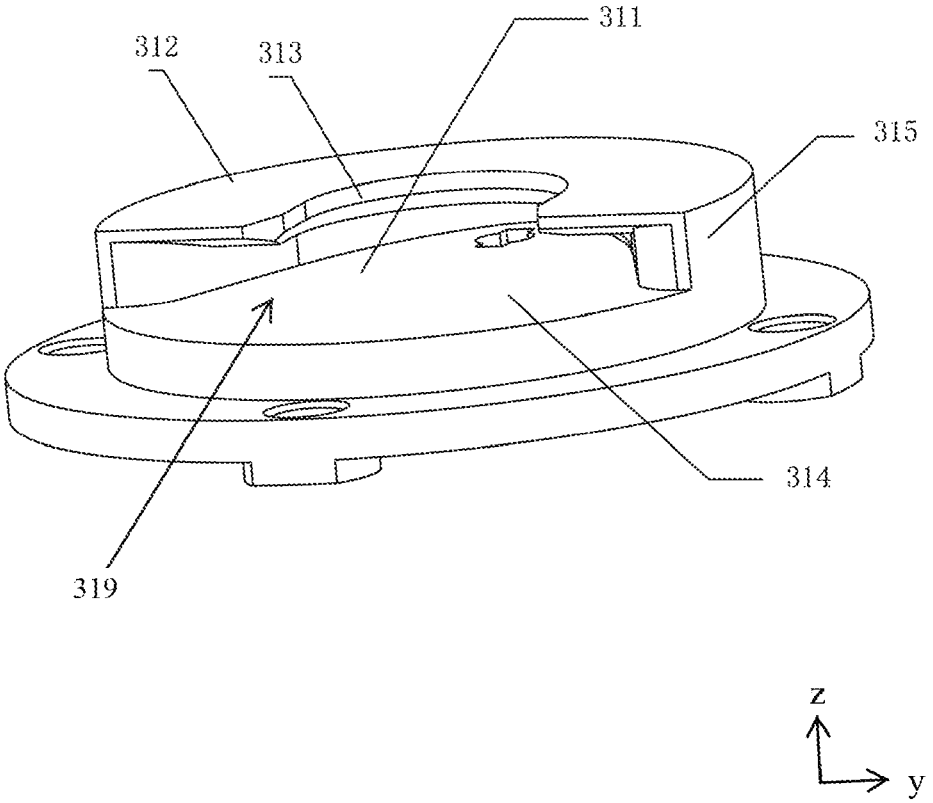
FIG. 9 illustrates a perspective view of a hanging sleeve of Embodiment 1 of the present disclosure.
Figure 10:
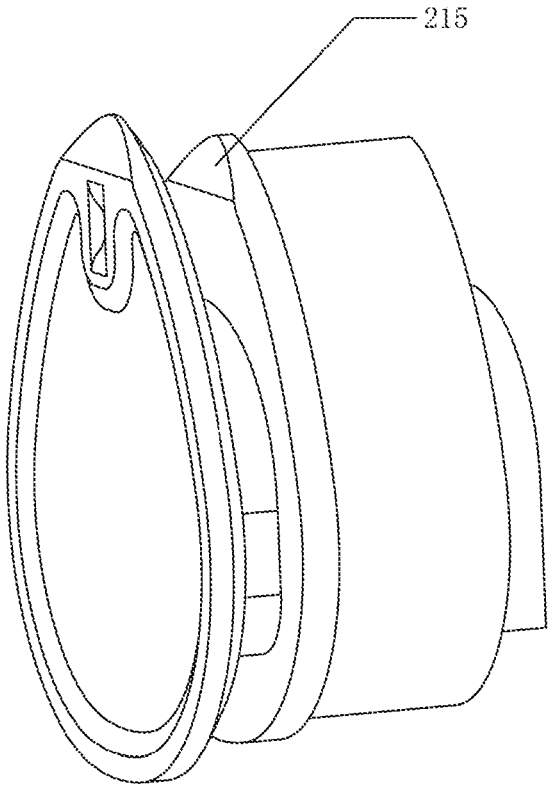
FIG. 10 illustrates a perspective view of a hanging hook of Embodiment 1 of the present disclosure.
Figure 11:
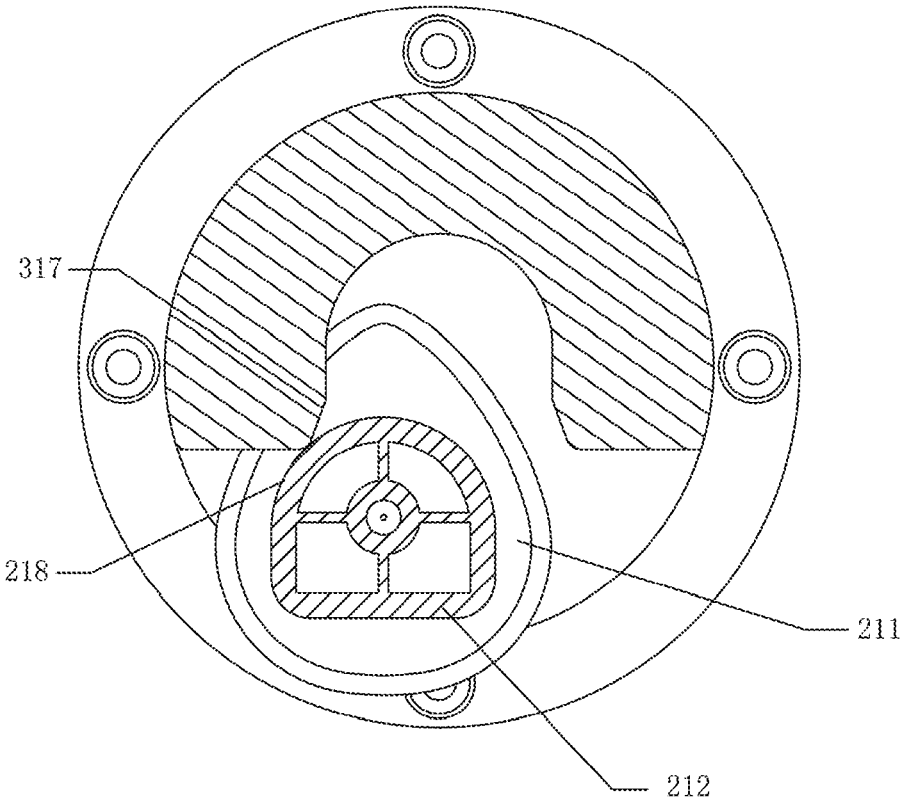
FIGS. 11-13 illustrate cross-sectional views of a process of a first portion and a second portion of the hanging hook entering into the hanging sleeve of Embodiment 1 of the present disclosure.
Figure 12:
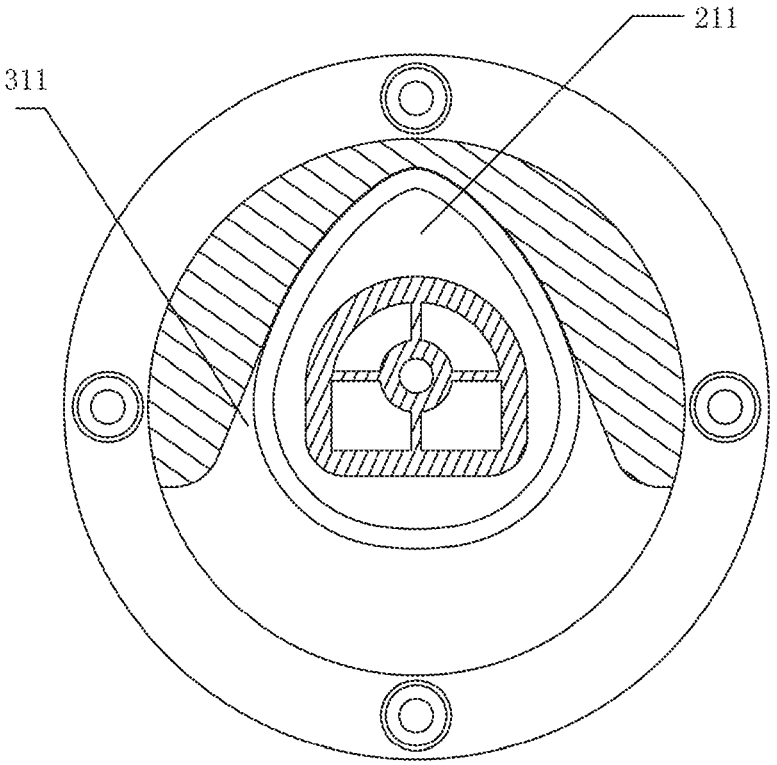
Figure 13:
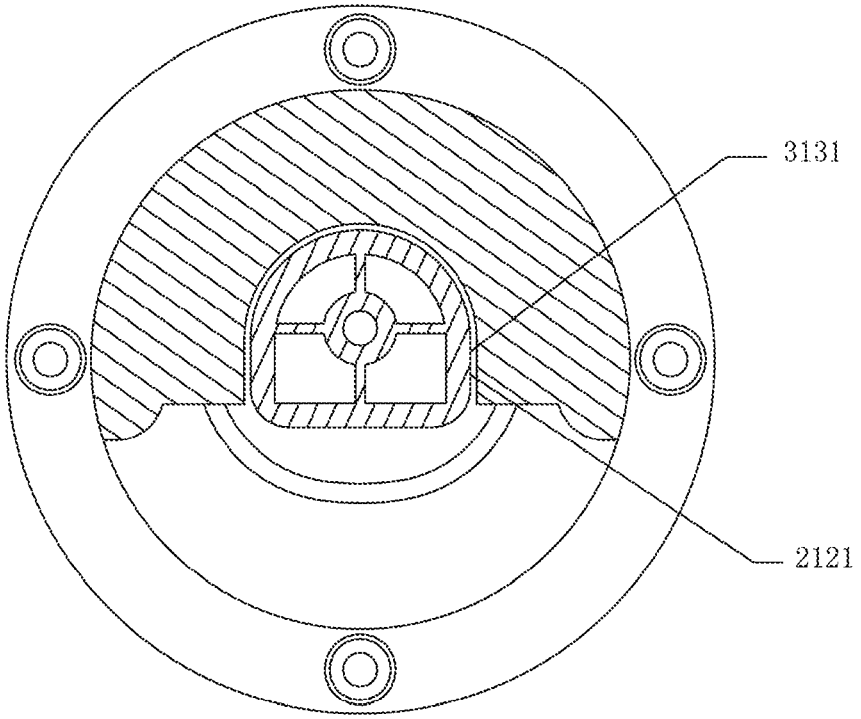
Figure 14:
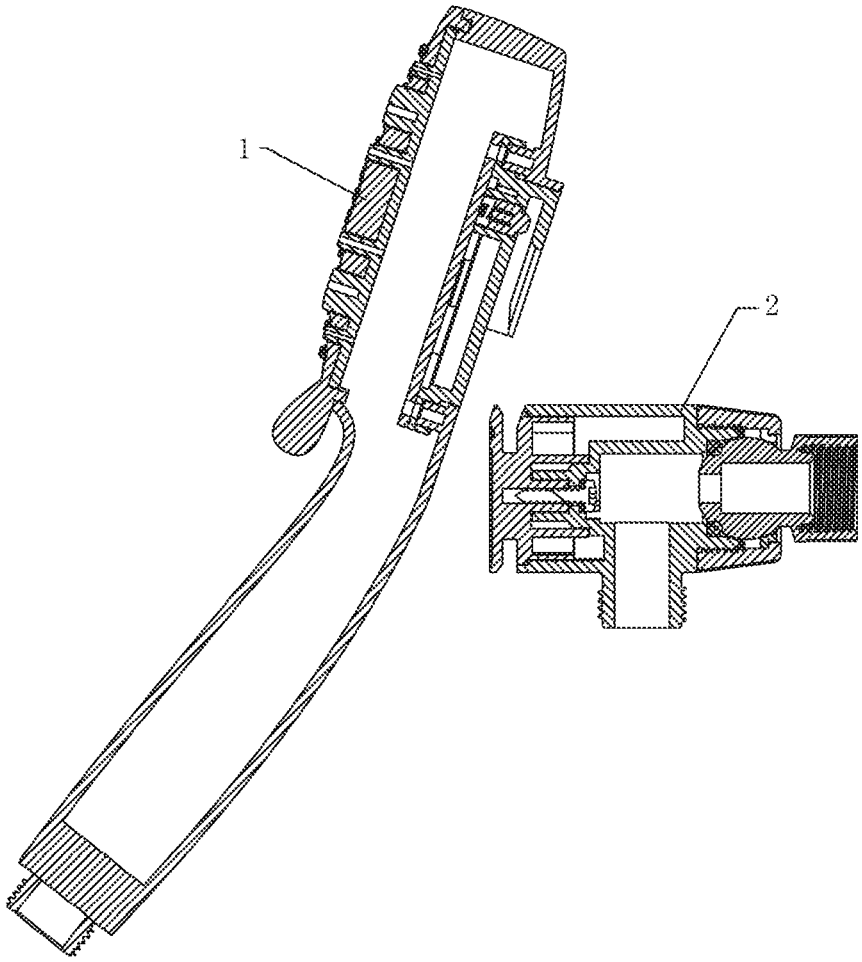
FIGS. 14-19 illustrate cross-sectional views of a hanging process of the handheld shower and the hanging seat of Embodiment 1 of the present disclosure.
Figure 15:
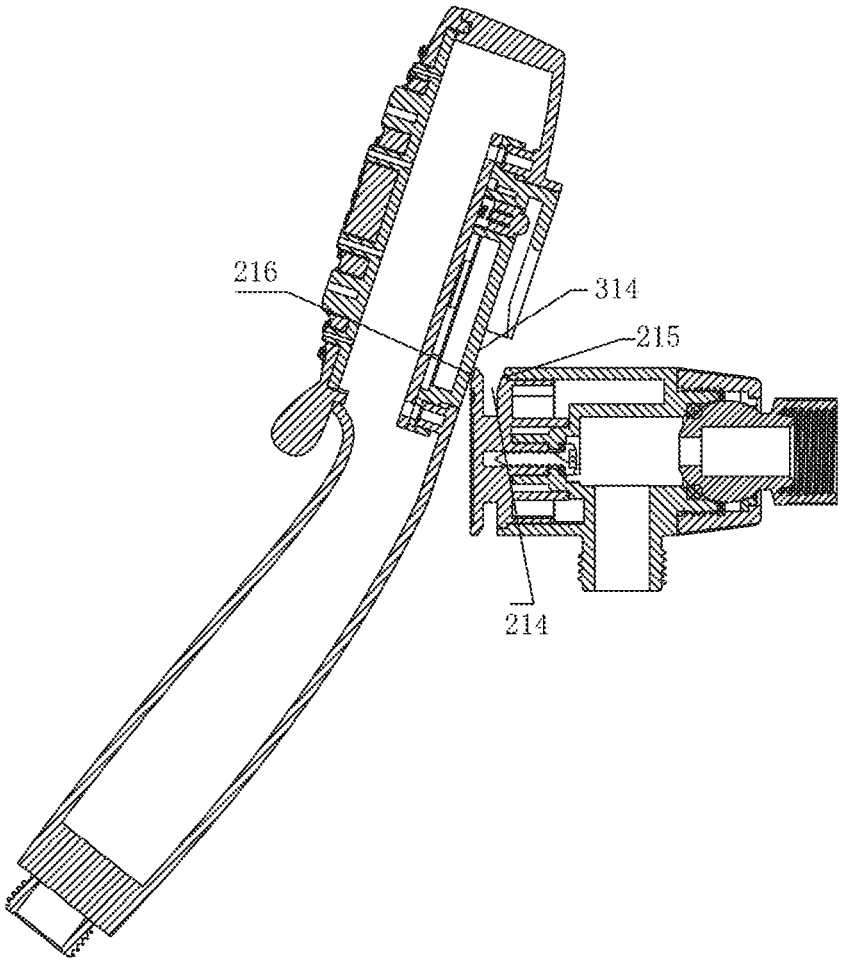
Figure 16:
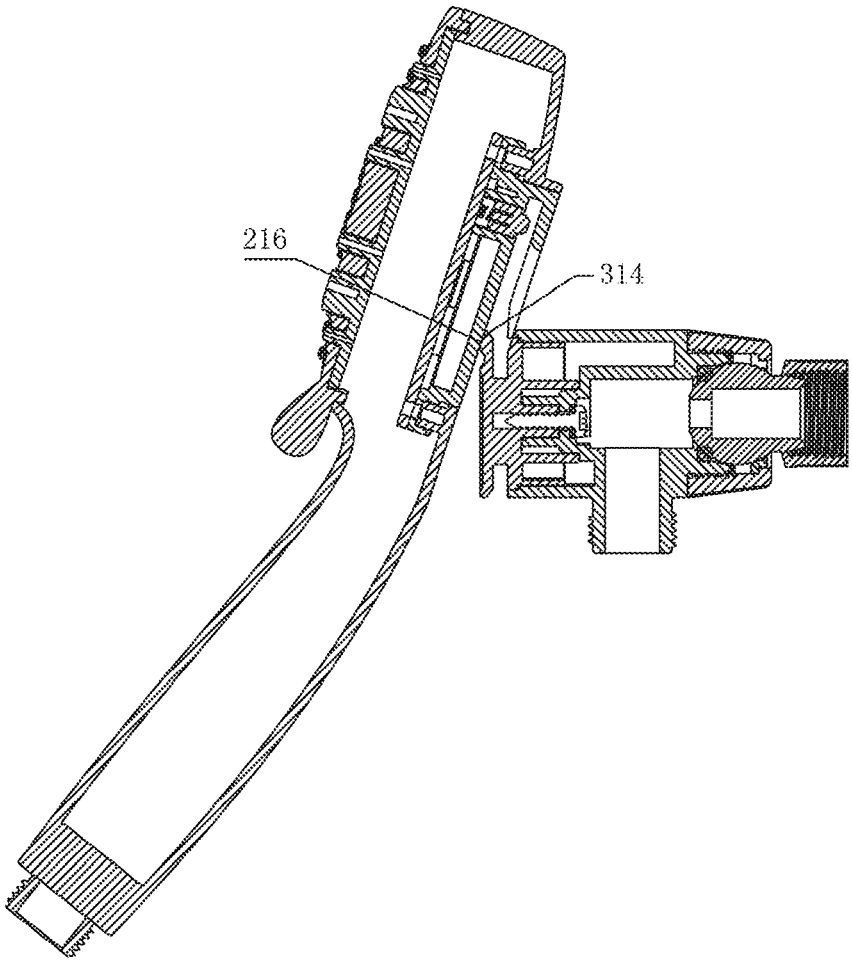
Figure 17:
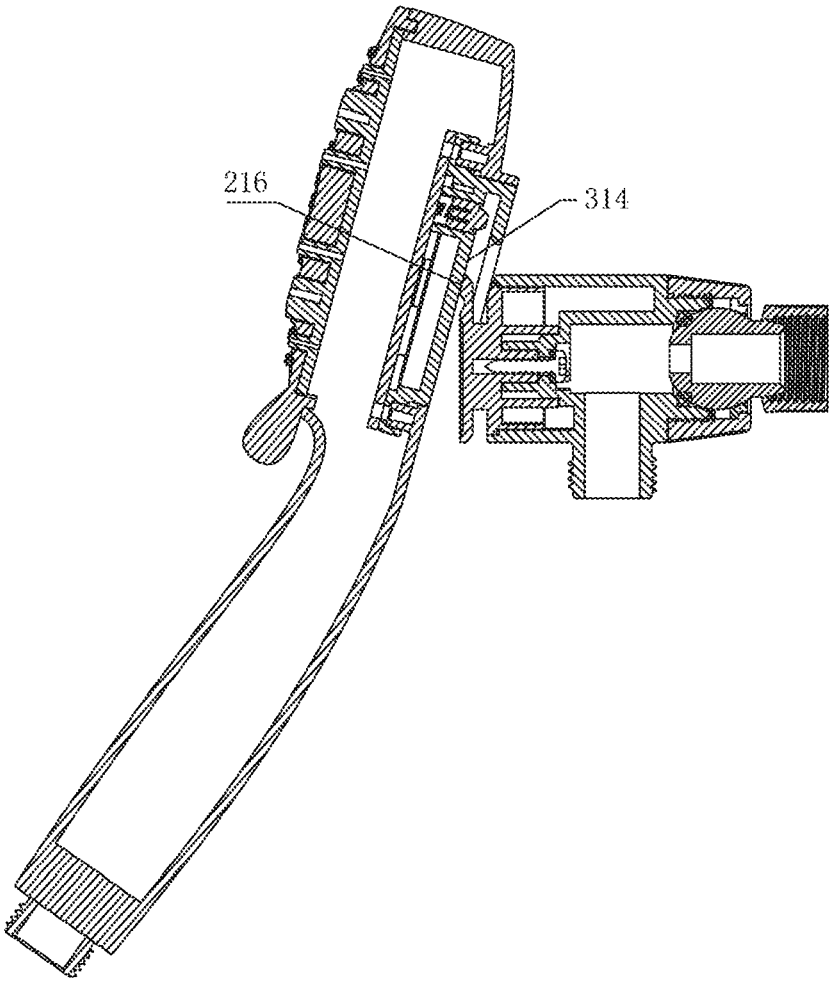
Figure 18:
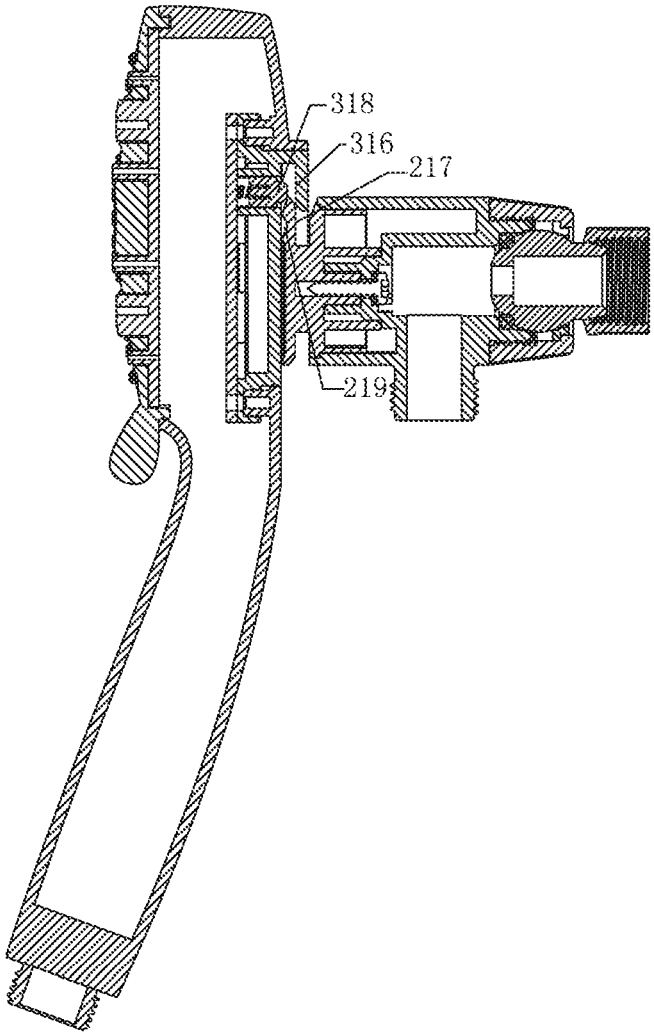
Figure 19:
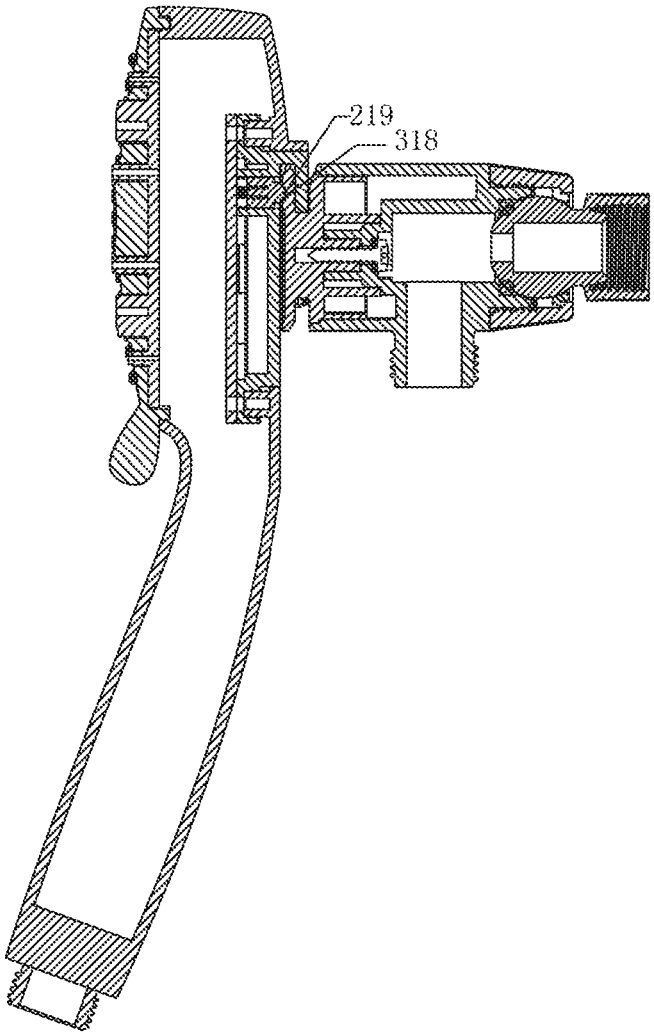

In this embodiment, the receiving cavity 311 gradually and upwardly narrows from the opening surface 319 in a width direction (e.g., measured along the y-axis in FIG. 9) and a thickness direction (e.g., measured along the z-axis in FIG. 9). Correspondingly, the first portion 211 has a wedge shape. After the first portion 211 enters into the receiving cavity 311, the wedge shape corresponds to a gradually narrowed shape of the receiving cavity 311 to enable a position of the handheld shower 1 to be automatically aligned.

In addition, a left side and a right side of the second portion 212 are respectively disposed with straight sections 2121, and a left side and a right side of the opening 313 are respectively disposed with straight sections 3131 corresponding to the straight sections 2121 to prevent the second portion 212 from rotating in the opening 313 and the handheld shower 1 from shaking.

Finally, the second side of the receiving cavity 311 away from the baffle board 312 is further disposed with a positioning pin 318, and the first portion 211 is disposed with a positioning hole 219 (or, a positioning groove 219) configured to cooperate with the positioning pin 318.

Referring to FIGS. 4-13, the hanging process between the handheld shower 1 and the hanging seat 2 is as follows.

The hanging process is mainly divided into three steps:

A first step: the handheld shower 1 is brought obliquely close to the hanging seat 2, so that the hanging sleeve 31 is engaged with the hanging hook 21.

Figure 4:
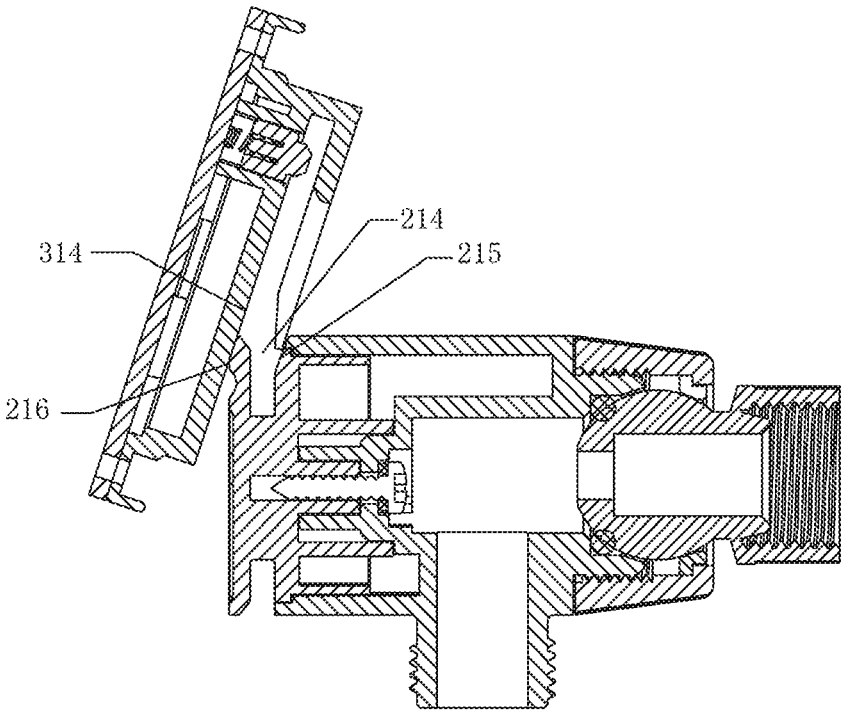
FIGS. 4-8 illustrate cross-sectional views of a hanging process of a hanging element and the hanging seat of Embodiment 1 of the present disclosure.
Figure 5:
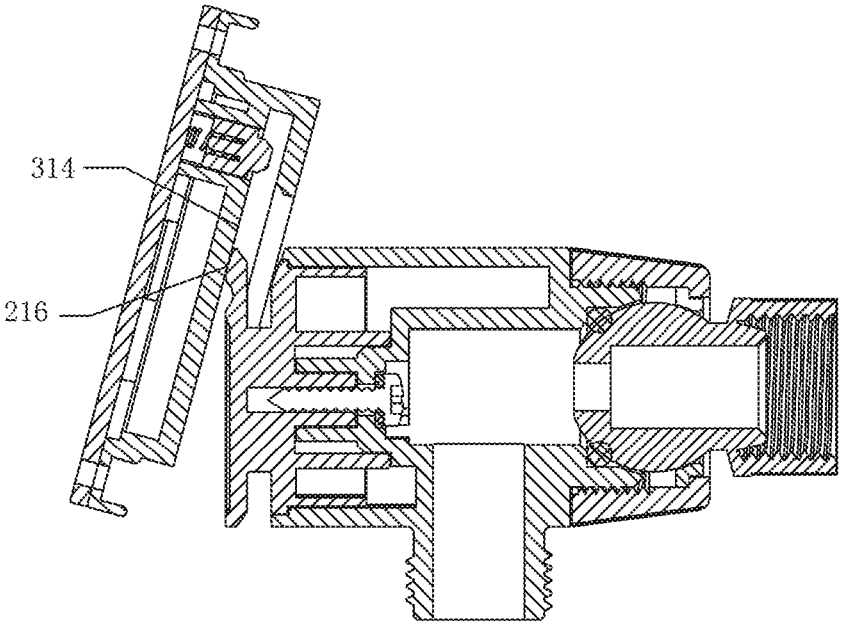

Referring to FIGS. 4 and 5, when the handheld shower 1 is inclined to abut the hanging seat 2, the first guiding surface 216 abuts the back plate 314, the handheld shower 1 continues to fall downward along the first guiding surface 216, and the hanging sleeve 31 is engaged with the hanging hook 21.

A second step: the handheld shower 1 is centered from a left side and a right side due to the second guiding surface 316 and the second guiding coupling surface 217, and the inclined angle of the handheld shower 1 gradually becomes smaller until perpendicular to the hanging seat 2.

Referring to FIGS. 6 and 11-13, the handheld shower 1 is guided by the second guiding surface 316 during the falling process of the handheld shower 1, and the inclined angle of the handheld shower 1 gradually becomes smaller until perpendicular to the hanging seat 2. The third guiding surface 317 cooperates with the third guiding coupling surface 218 to enable the handheld shower 1 to be centered in a vertical direction.

Figure 6:
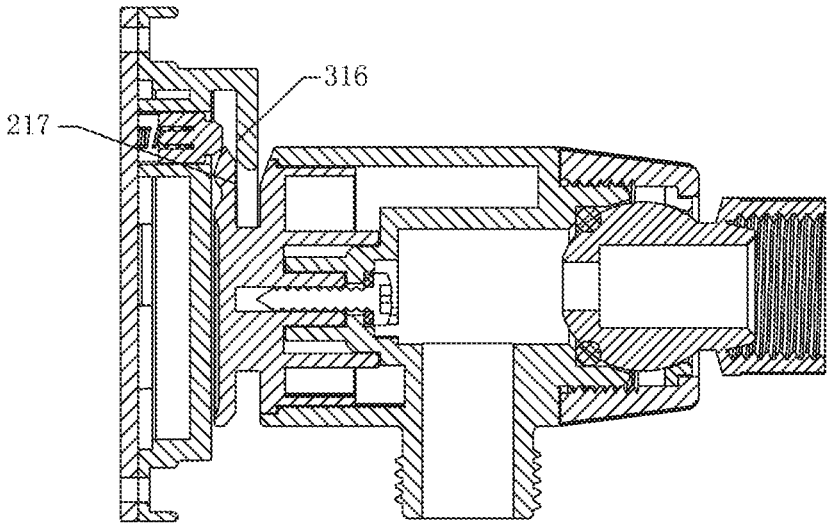
Figure 7:
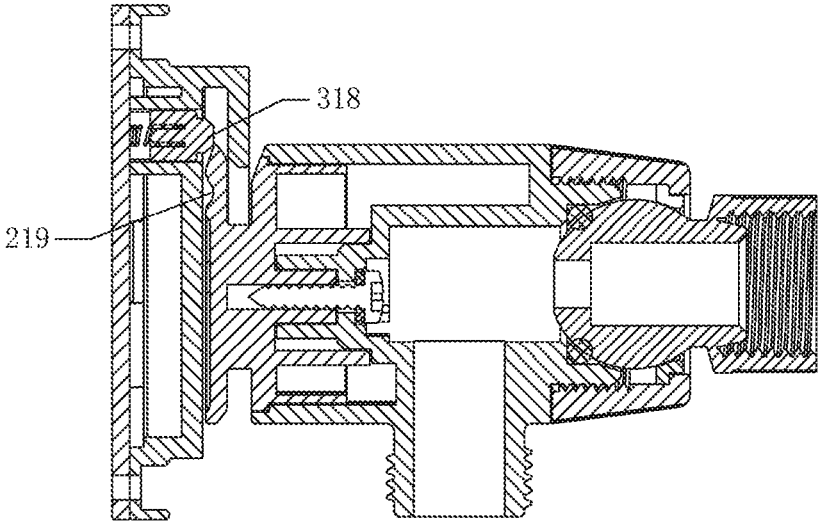
Figure 8:
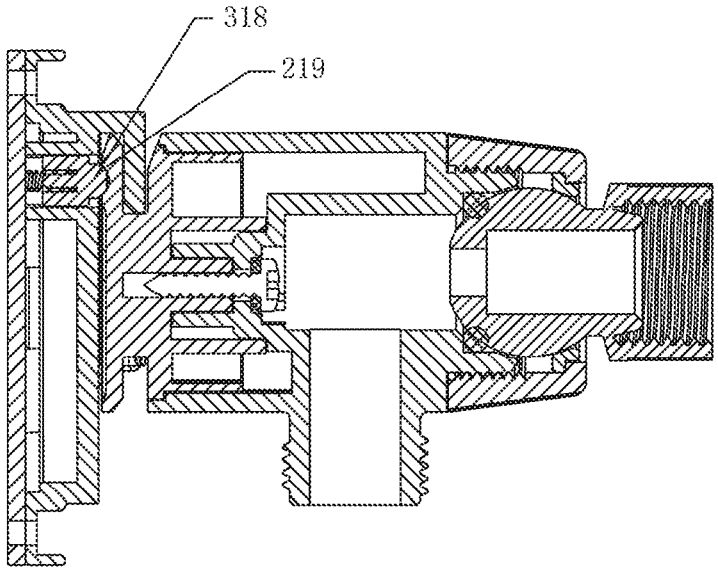

A third step: referring to FIGS. 7, 8, and 11-13, the handheld shower 1 is hung in position, and the positioning hole 219 of the hanging hook 21 cooperates with the positioning pin 318 to generate an indicator sound to remind the user that the handheld shower 1 has been positioned. The positioning pin 318 can also restrict the handheld shower 1 from swinging in a left direction and a right direction and separating away from the hanging hook 21 due to upward motion. When the hanging sleeve 31 is completely engaged with the hanging hook 21, an inner surface of the hanging sleeve 31 completely couples to the wedge shape of the hanging hook 21 to achieve a guiding function, so that the handheld shower 1 always remains vertical. Referring to FIG. 6, the hanging sleeve 31 and the hanging hook 21 both have straight sections configured to cooperate with each other to prevent rotation.

Embodiment 2

Figure 20:
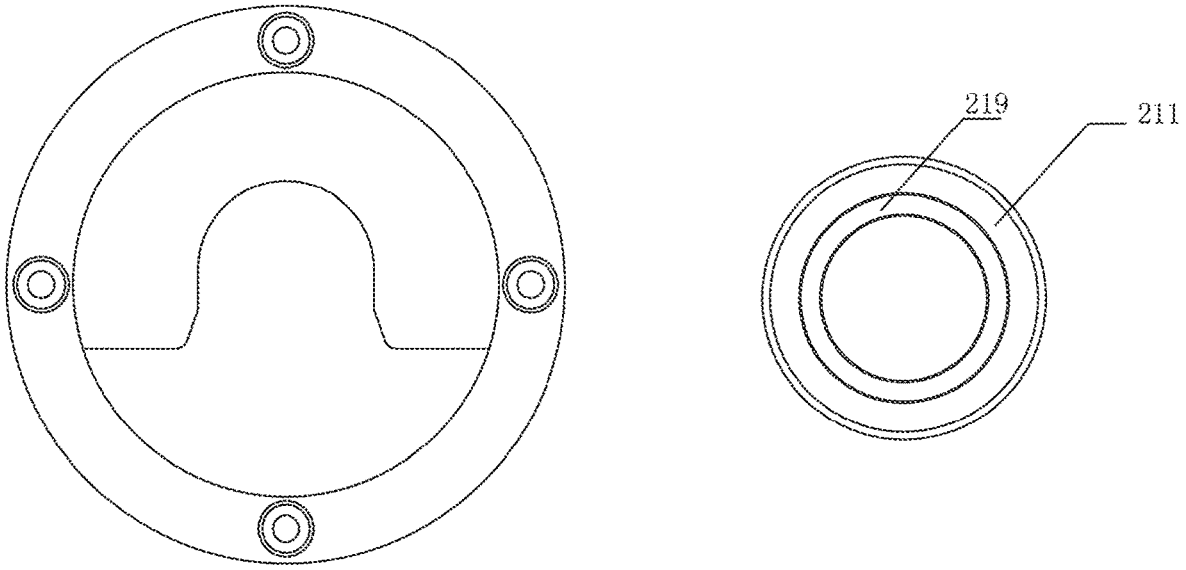
FIG. 20 illustrates a schematic view of a first portion of Embodiment 2 of the present disclosure.

Referring to FIG. 20, this embodiment differs from Embodiment 1 in that the first portion 211 has a circular shape. Further, the positioning hole 219 is a circular ring. As the positioning hole 219 is a circular ring, the handheld shower 1 can be hung on the hanging seat 2 from any angle.

Embodiment 3

Figure 21:
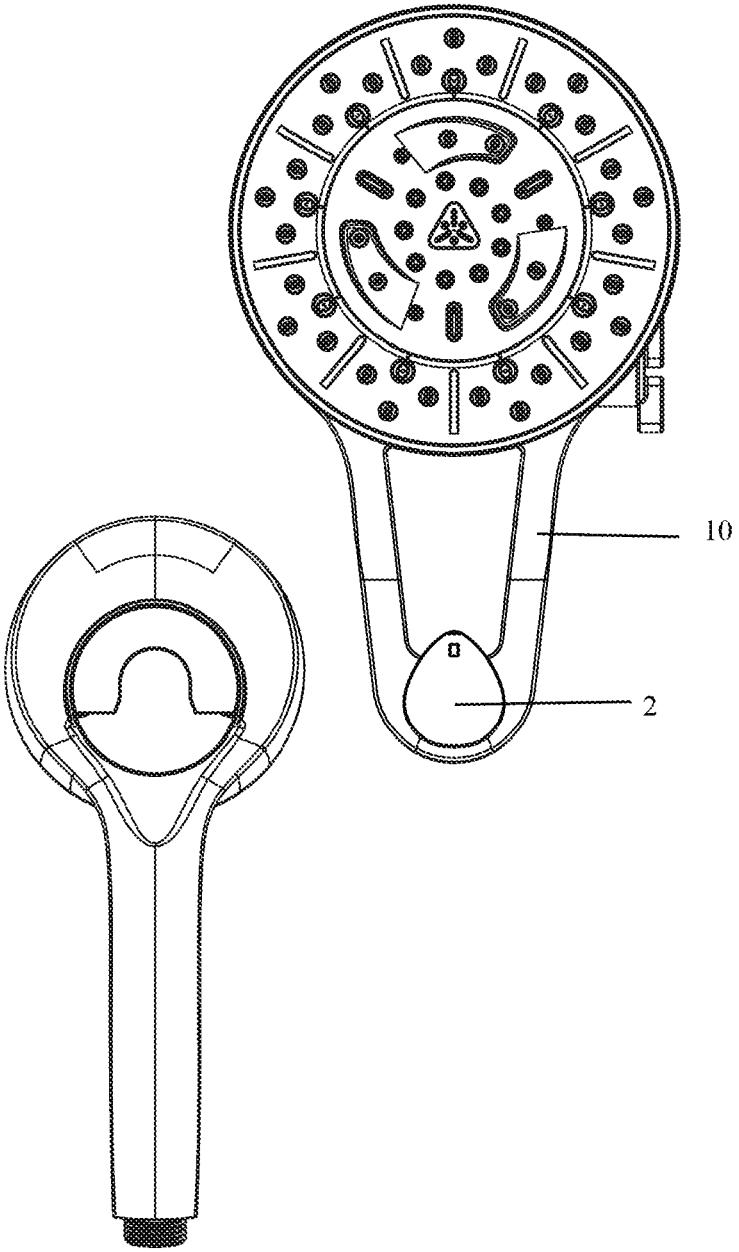
FIG. 21 illustrates a schematic view of a top spray shower and a handheld shower of Embodiment 3 of the present disclosure.

Referring to FIG. 21, this embodiment differs from the Embodiment 1 in that the hanging seat 2 is disposed on a top spray shower 10, so that the handheld shower 1 is hung on the top spray shower 10 to define a combination shower.

Embodiment 4

Figure 22:
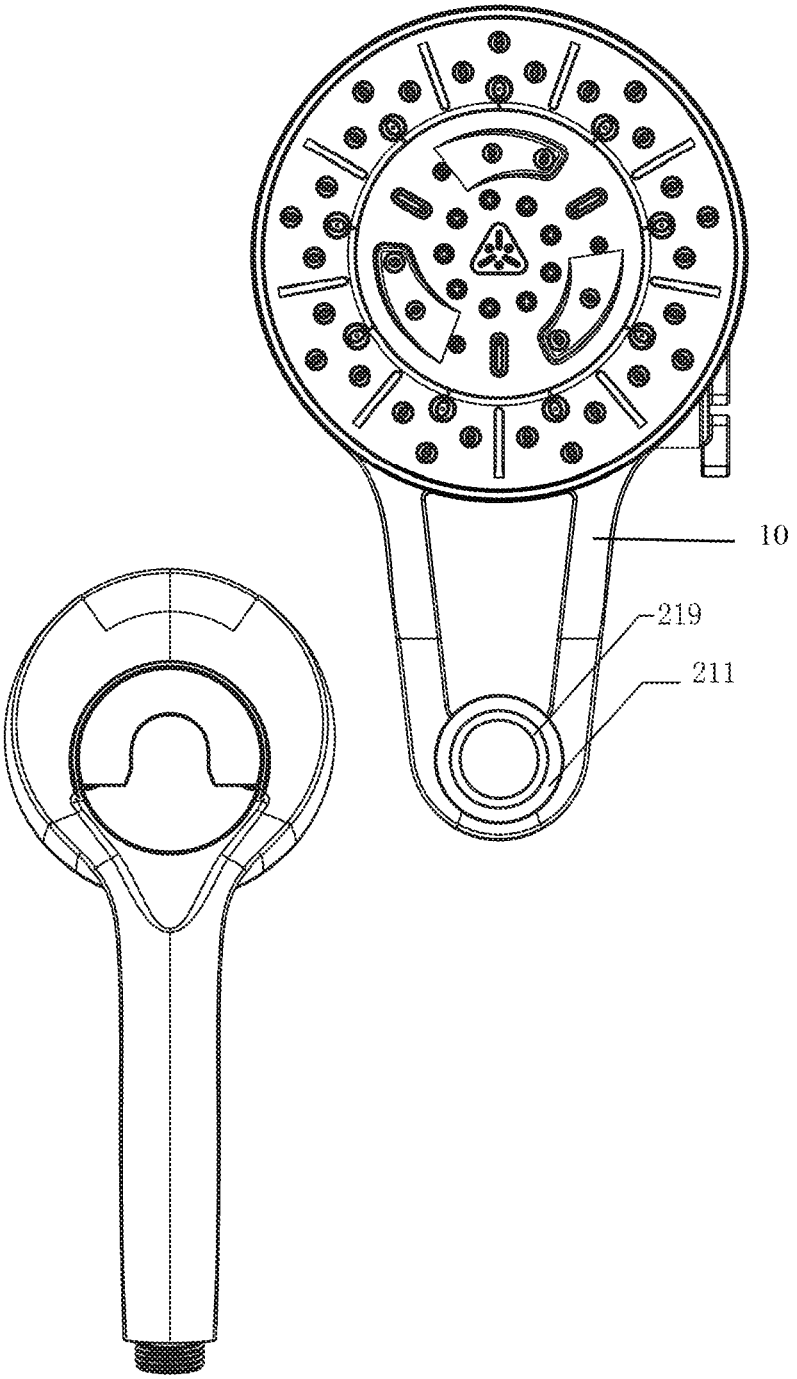
FIG. 22 illustrates a schematic view of a top spray shower and a handheld shower of Embodiment 4 of the present disclosure.

Referring to FIG. 22, this embodiment differs from Embodiment 3 in that the first portion 211 has a circular shape. Further, the positioning hole 219 is a circular ring. As the positioning hole 219 is a circular ring, the handheld shower 1 can be hung on the top spray shower 10 from any angle.

It will be apparent to those skilled in the art that various modifications and variation can be made in the present disclosure without departing from the spirit or scope of the invention. Thus, it is intended that the present disclosure cover the modifications and variations of this invention provided they come within the scope of the appended claims and their equivalents.

What is claimed is:

1. A hanging structure, comprising:

a hanging element, and a hanging seat, wherein:

one of the hanging element or the hanging seat comprises one of a hanging sleeve or a hanging hook and the other of the hanging element or the hanging seat comprises the other of the hanging sleeve or the hanging hook, the hanging sleeve and the hanging hook are configured to define a detachable hanging connection, the hanging sleeve comprises a receiving cavity, a lower portion of the receiving cavity comprises an opening surface, a first side of the receiving cavity facing the hanging hook comprises a baffle board, a lower end surface of the baffle board comprises an opening extending toward an upper end surface of the baffle board, the hanging hook comprises a first portion configured to be disposed in the receiving cavity and a second portion configured to be disposed in the opening, the second portion is disposed on a side of the first portion away from the hanging sleeve, a side of the second portion away from the first portion is further connected to a third portion of the hanging hook, at least a portion of the second portion extends inward with respect to the first portion and the third portion to define a recess between the first portion and the third portion, the receiving cavity gradually and upwardly narrows from the opening surface in a width direction, and the receiving cavity gradually and upwardly narrows from the opening surface in a thickness direction.

2. The hanging structure according to claim 1, wherein during a hanging process between the hanging hook and the hanging sleeve, the first portion is initially received in the receiving cavity and then the second portion is received in the opening.

3. The hanging structure according to claim 2, wherein:

the at least a portion of the second portion comprises an upper portion of the second portion that extends inward with respect to the first portion and the third portion to define the recess, and the recess is between an upper portion of the first portion and an upper portion of the third portion.

4. The hanging structure according to claim 3, wherein the upper portion of the third portion comprises a space-providing opening configured to increase an opening width of the recess.

5. The hanging structure according to claim 3, wherein:

a side of the upper portion of the first portion facing the hanging sleeve comprises a first guiding surface, and a second side of the receiving cavity away from the baffle board defines a first guiding coupling surface configured to cooperate with the first guiding surface.

6. The hanging structure according to claim 5, wherein:

an inner side wall of the baffle board facing the receiving cavity comprises a second guiding surface, and a side of the first portion facing the recess comprises a second guiding coupling surface configured to guide and cooperate with the second guiding surface.

7. The hanging structure according to claim 1, wherein:

the baffle board comprises a third guiding surface disposed on both sides of a lower end of the opening, and an upper end of the second portion comprises a third guiding coupling surface configured to cooperate with the third guiding surface.

8. The hanging structure according to claim 1, wherein:

the first portion is wedge shaped or circular shaped, and two sides of the first portion respectively abut two side walls of the receiving cavity to achieve positioning.

9. The hanging structure according to claim 8, wherein:

a left side and a right side of the second portion are respectively disposed with straight sections, and a left side and a right side of the opening are respectively disposed with straight sections corresponding to the straight sections of the left side and the right side of the second portion.

10. The hanging structure according to claim 8, wherein:

a second side of the receiving cavity away from the baffle board is disposed with a positioning pin, and the first portion is disposed with a positioning hole configured to cooperate with the positioning pin.

11. The hanging structure according to claim 10, wherein the positioning hole is a circular hole or a circular ring extending along a circumferential direction of a surface of the first portion.

12. A handheld shower, comprising:

the hanging structure according to claim 1, wherein:

the hanging element is disposed on the handheld shower, and the hanging seat is disposed on a wall surface or a top spray shower.

13. A hanging structure, comprising:

a hanging element, and a hanging seat, wherein:

one of the hanging element or the hanging seat comprises one of a hanging sleeve or a hanging hook and the other of the hanging element or the hanging seat comprises the other of the hanging sleeve or the hanging hook, the hanging sleeve and the hanging hook are configured to define a detachable hanging connection, the hanging sleeve comprises a receiving cavity, a lower portion of the receiving cavity comprises an opening surface, a first side of the receiving cavity facing the hanging hook comprises a baffle board, a lower end surface of the baffle board comprises an opening extending toward an upper end surface of the baffle board, the hanging hook comprises a first portion configured to be disposed in the receiving cavity and a second portion configured to be disposed in the opening, the second portion is disposed on a side of the first portion away from the hanging sleeve, a side of the second portion away from the first portion is further connected to a third portion of the hanging hook, at least a portion of the second portion extends inward with respect to the first portion and the third portion to define a recess between the first portion and the third portion, the first portion is wedge shaped or circular shaped, two sides of the first portion respectively abut two side walls of the receiving cavity to achieve positioning, a second side of the receiving cavity away from the baffle board is disposed with a positioning pin, and the first portion is disposed with a positioning hole configured to cooperate with the positioning pin.

* * * * *